United States Patent [19]

Leask

[11] Patent Number: 4,927,136

[45] Date of Patent: May 22, 1990

[54] BRAKING SYSTEM FOR EXERCISE APPARATUS

[75] Inventor: John W. Leask, Carlisle, Mass.

[73] Assignee: Engineering Dynamics Corporation, Lowell, Mass.

[21] Appl. No.: 294,478

[22] Filed: Jan. 6, 1989

[51] Int. Cl.[5] ..... A63B 23/06

[52] U.S. Cl. ..... 272/69; 272/70; 272/96; 272/129; 198/323

[58] Field of Search ..... 272/69, 70, 96, 112, 272/129; 198/323

[56] References Cited

U.S. PATENT DOCUMENTS

| | | | |
|---|---|---|---|
| 625,905 | 5/1989 | Souder | 198/327 |
| 683,124 | 9/1901 | Lange | 198/327 |
| 782,010 | 2/1905 | Dodge . | |
| 783,769 | 2/1905 | Wright | 198/333 |
| 1,239,077 | 9/1917 | Begg . | |
| 3,497,215 | 2/1970 | Harrison et al. . | |
| 3,592,466 | 7/1971 | Parsons | 272/69 |
| 3,602,502 | 8/1971 | Hampl | 272/69 |
| 3,711,812 | 1/1973 | Cherry | 272/69 X |
| 3,765,245 | 10/1973 | Hamfel | 73/379 |
| 3,896,925 | 7/1925 | Mitsui et al. | 198/323 |
| 3,962,595 | 6/1976 | Eddews | 310/93 |
| 4,085,344 | 4/1978 | Eddins | 310/93 X |
| 4,130,014 | 12/1978 | Eddins . | |
| 4,347,993 | 9/1982 | Leonard | 242/75.51 |
| 4,350,913 | 9/1982 | Eddins | 310/103 |
| 4,416,293 | 11/1983 | Anderson et al. | 272/69 X |
| 4,470,597 | 9/1984 | McFee | 272/128 |
| 4,588,065 | 5/1986 | Maiden et al. | 198/323 |
| 4,643,418 | 2/1987 | Bart | 272/69 |
| 4,687,195 | 8/1987 | Potts | 272/69 |
| 4,708,338 | 11/1987 | Potts | 272/69 X |
| 4,714,244 | 12/1987 | Kolomayets et al. | 272/72 |
| 4,798,378 | 1/1989 | Jones | 272/72 |
| 4,822,036 | 4/1989 | Dang | 272/125 X |
| 4,848,737 | 7/1989 | Ehrenfield | 272/69 X |

FOREIGN PATENT DOCUMENTS

| | | | |
|---|---|---|---|
| 1245324 | 7/1986 | U.S.S.R. | 272/69 |

OTHER PUBLICATIONS

"Equipnews" by New & Used Equipment News Letter, May/Jun. 1988.

*Primary Examiner*—Richard J. Apley
*Assistant Examiner*—Joe H. Cheng
*Attorney, Agent, or Firm*—Robert K. Tendler

[57] ABSTRACT

An electromechanical and more particularly an electromagnetic brake is utilized in the control of exercise equipment including escalator type stair-climbing apparatus, in which electronically controllable torque, including a clamping torque, is applied to a rotary shaft to load the exercise equipment, thereby giving complete electronic control to the operation of the exercise apparatus including a safety locking function.

13 Claims, 3 Drawing Sheets

BRAKING SYSTEM FOR EXERCISE APPARATUS

FIELD OF THE INVENTION

This invention relates to exercise equipment and more particularly to a safety braking system to prevent injury to the user, and to more easily control the load on the exercise equipment.

BACKGROUND OF THE INVENTION

While various types of exercise equipment exist, none appear more popular than stair climbing apparatus which simulates an escalator. This type of equipment exemplified by U.S. Pat. No. 4,687,195 utilizes pure mechanical braking apparatus which applies a braking torque to a sprocket-supported drive chain attached to the escalator stairs. In the past it has been the subject of some debate as to the safety of such devices, which use a mechanical lever-actuated braking system to provide a load to the shaft of one of the sprockets over which the drive chain runs. The reason for the concern is that in this type system an individual seeking to use the apparatus can mount the machine when the stairs are not in a braked condition. Upon so doing, the individual is thrown to the ground in front of the apparatus as the stair on which he places his foot fails to support him due to the unbraked condition of the apparatus.

While health clubs and the like require those utilizing exercise machinery to be thoroughly familiar with exercise equipment, accidents nonetheless happen when, for instance, mechanical braking apparatus is not initially actuated or even when it is partially engaged and the individual seeks to stop exercising. The result is however still the same, in that the individual can be thrown to the floor or otherwise injured due to the unbraked movement of the escalator.

In general, it will be appreciated, that while other exercise equipment may have a built-in loading system such as hydraulically-loaded exercise apparatus, escalator type equipment, while exceedingly beneficial in providing aerobic points to the user, is nonetheless considered relatively unsafe, due to the unique construction of the escalator which can result in the stairs running downward in an uncontrolled manner. If no load or very little load is initially placed on the stairs, this condition may not be noticed by the individual seeking to utilize the exercise equipment, with the result that it throws him to the ground, or otherwise results in injury.

There is however another problem with the utilization of mechanically-controlled escalator type exercise apparatus; and that is the ability to program or smoothly control the load placed on the stairs so as to simulate various types of athletic endeavor involving various types and difficulties of stair climbing. In the above patent, the stair climbing exercise is controlled by the braking torque applied by a pure mechanical brake system to the shaft of the sprocket engaged in controlling the speed of the escalator. Thus the machine cannot be easily computer-programmed.

In terms of exercise control, it will be appreciated that it is the weight of the individual acting against the retarding torque which controls the speed of exercise. The greater the torque, the slower the operation of the stairs and therefore the lower will be the amount of exercise involved. As will be noted, it is the stepping rate at which the individual exercises which is the measure of the exercise involved. By reducing the load on the sprocket shaft, the stairs move more quickly and the individual to maintain his position on the stair must move more rapidly, raising his body weight every time he takes a step. Thus reducing load increases exercise The ability to easily control the load and thus the exercise rate is thus not available when using pure mechanical braking of the stairs.

By way of further background, alternators have been utilized to provide load to various types of exercise equipment, although not exercise stairs. Here a large load resistor is placed across the alternator to provide a braking torque, with the resistor being a multi-tapped resistor under the control of a braking routine specified by the exercise program.

What will be appreciated is that such devices can never completely stop or clamp the rotary apparatus of the exercise machine to which the alternator is coupled. While the alternator can vary the braking torque, this device alone cannot lock up the exercise machine, making its use alone incapable of providing the safety of a completely immobilized and secured exercise machine.

SUMMARY OF THE INVENTION

In order to provide for better safety and control, an electromechanical and more particularly an electromagnetic brake is utilized in the control of exercise equipment including escalator type stair-climbing apparatus, in which electronically controllable torque, including a clamping torque, is applied to a rotary shaft to load the exercise equipment, thereby giving complete electronic control to the operation of the exercise apparatus, as well as a safety locking function. In a preferred embodiment, a magnetic particle brake capable of complete shaft or rotor clamping with application of full power provides safety in the utilization of the exercise device. One such magnetic particle braking system is described in U.S. Pat. Nos. 3,962,595; 4,085,344 and 4,350,913. Using such a magnetic particle brake, an individual can mount the exercise device and then deactivate the magnetic brake so as to remove the clamping force while at the same time providing a controlled retarding force which acts against the force exerted by the exercising individual. Another type of electromagnetic brake which provides rotor clamping is the hysteresis brake. When used with exercise stairs or indeed any exercise equipment which locates the individual up off the floor, brake clamping provides extra security.

In another embodiment the electromagnetic braking system includes a speed-controlled motor. It is a characteristic of these types of motors that an initial speed dictated by the application of power to the motor is maintained regardless of load conditions. This type of system is exceptionally well adapted for use as a brake for exercise equipment, since the feedback control which maintains motor speed acts to brake the exercise device when exercise results in a speed up of respective parts of the exercise machine.

In a further embodiment, brake clamping is released only when the exercising individual is on the exercise apparatus ready to exercise, which condition, in the case of an escalator, is determined by the individual reaching to an elevated start/stop button, preferably on a monitor at head level. This prevents actuation of an escalator type stair climbing device until the individual is positioned on the exercise stair and is ready to exercise. Thus the braking system is released only when the individual is on the exercise apparatus and starts the program cycle of the exercise machine by pressing the ON button.

In a still further embodiment, application of control power to the braking apparatus between the time that it is released from a clamped condition until it reaches its designated load is controlled by the slow release of brake pressure for a cushioned start-up, with a predetermined load being preset such that the braking device always provides a minimum torque to prevent injury to the individual using the exercise machine. Especially for escalator type machines, the ability to cushion transitions from one program cycle to the next produces less of a jolt to the individual than pure mechanical braking systems. The combination of an electromagnetic brake and a microprocessor provides complete smooth control for any rotary motion exercise machine, even those which translate reciprocating motion to rotary motion.

It is therefore an object of the Subject Invention to provide escalator type exercising apparatus with an electromechanical braking system including alternators, eddy current devices, magnetic particle brakes, speed-controlled motors, or solenoid actuated mechanical brakes, as opposed to a pure mechanical braking system, such that the braking system may be controlled by microprocessor-based brake-driving circuitry.

It is another object of the Subject Invention to provide an electromechanical braking system in which the system provides complete clamping force on a shaft to rigidly lock the exercise apparatus prior to the time that an individual manually operates a start switch. The electromechanical braking system is actuatable to mechanically lock the exercise apparatus either when the individual turns off the machine, or when the exercise program ends, thereby to provide an element of safety not presently available.

It is still a further object of the invention to provide an electromagnetic braking system for elevated exercise apparatus or apparatus which is high up off the floor such that it is actuated only when the individual is located on the exercise apparatus, thereby to preclude actuation of the apparatus prior to the time that the exercising individual is ready to exercise.

It is a still further object of this invention to provide a magnetic brake with shaft clamping means which is activated until such time as an individual is situated at the proper position of the exercise machine, such that complete immobilization is accomplished until the clamping power is removed from the magnetic brake.

It is a still further object of the Subject Invention to provide a magnetic particle brake for exercise apparatus.

It is a yet further object of the invention to provide a system in which the on/off switch for the exercise program is operatable only when the individual is in a suitable position for utilization of the particular exercise device.

It is a yet still further object of the invention to provide for the slow application of power to an electrically-powered braking device for utilization with rotary exercise equipment, so as to provide for a cushioned start-up to the exercise device once a start sequence has been initiated.

It is another object of the Subject Invention to provide an electrical braking system in which a minimum braking torque is always applied to the exercise apparatus to prevent injury.

BRIEF DESCRIPTION OF THE DRAWINGS

These and other objects of the Subject Invention will be better understood in connection with the Detailed Description taken in conjunction with Drawings of which.

DETAILED DESCRIPTION

Figure 1:
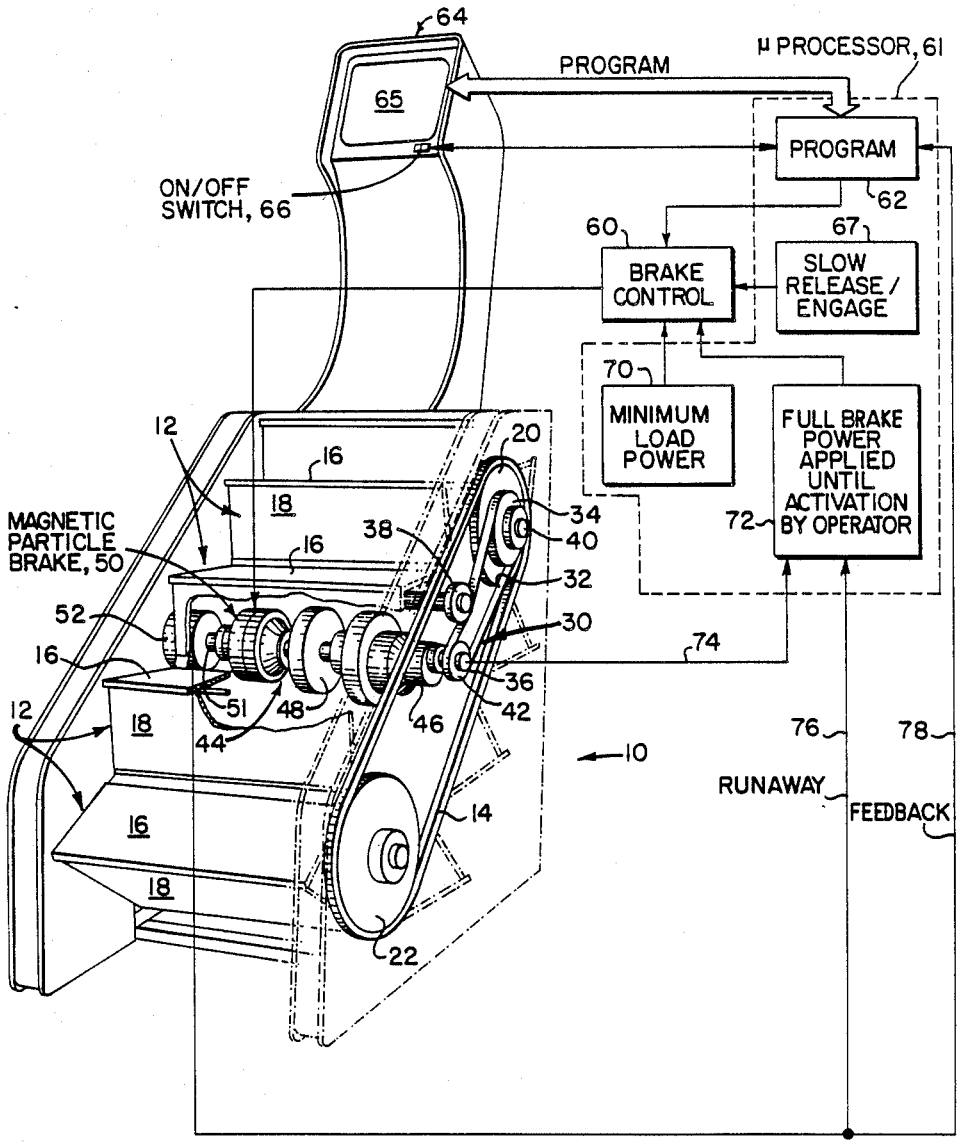
FIG. 1 is a perspective and cut-away view of the subject braking system for utilization in an escalator type exercise apparatus illustrating the control of the electromagnetic brake.

Referring now to FIG. 1, an escalator type exercising device 10 is illustrated having a plurality of stairs 12 which are driven by an endless chain or belt 14 or suitable means, with the tread portions 16 and the riser portions 18 being connected at both ends by a plurality of hinges to each other and to endless chain or belt 14 such that the steps move or fold around end sprockets or pulleys 20 and 22 as the steps move from an upper incline course to a lower inclined returned course and vice versa. An electromagnetically-controlled speed control mechanism is generally indicated at reference character 30 to include a belt or chain 32 which is wrapped around respective sprockets or pulleys 34 and 36 with an idler roller 38 employed to tension the belt or chain about these pulleys or sprockets.

The movement of the steps 12 in a downward direction causes rotation of shaft 40, thereby causing rotation of shaft 42 which is coupled to speed control mechanism 44 that includes, in one embodiment, a reduction gear 46, a fly wheel 48 and a magnetical particle brake 50, having an output shaft 51 which is in turn coupled to a tachometer 52.

It is the purpose of the electromagnetic braking system to provide a counter torque to that provided by an individual climbing the steps 12 so that the speed of his exercise is determined by the amount of retarding torque or force applied through brake 50.

While a magnetic particle brake 50 is illustrated in the preferred embodiment, any electromagnetic braking device is acceptable as long as it can be powered to a complete locking condition, which as will be seen locks its output shaft and thus locks the steps in place along there respective inclines. It will be appreciated that the vertical rise of such a machine may be as much as five feet and that it is possible for an individual utilizing this type of exercise machine to fall five feet to the floor should the braking mechanism fail or not be engaged, such that the steps would virtually be in a free-wheeling descent.

In order to eliminate such an occurrence, a brake control unit 60 applies power to magnetic particle brake 50 in accordance with signals from a microprocessor control unit 61. The microprocessor has stored therein a number of exercise programs 62 which are selected at an elevated display/screen 64 which, in one embodiment may include a touch sensitive screen 65 capable of providing appropriate instructions to the microprocessor.

The microprocessor control unit is activated to start or stop its particular routine for providing control signals to brake control 60 through the utilization of an on/off switch 66 which is mounted on display 64, and which is connected to the microprocessor control unit for causing the microprocessor to remove initial locking power to the magnetic particle brake. It will be appreciated that in the absence of any instructions otherwise from the microprocessor, brake control unit 60 applies maximum power to the magnetic particle brake so that in its normal condition its output shaft is fully locked. It is a property of this particular brake that a predetermined amount of current will cause positive locking between the stationary and rotary elements within the magnetic particle brake, thereby to completely immobilize the steps of the escalator-type exercise machine.

Upon actuation of on/off switch 66, microprocessor control unit 61 exercise program 62 entered at display 64 and releases a portion of the brake current to magnetic particle brake 50 thereby to free up the stairs in the manner dictated by microprocessor control unit 61 and the programs stored therein.

There is however a slow release/engage function programmed into the microprocessor as illustrated at 67 which assures that the change in control current to the magnetic particle brake is relatively slow, therefore to effectuate a change in loading condition which is not sharp but rather has a predetermined dwell time or hysteresis, so that the person utilizing the exercise device will not experience discomfort.

Also an override function 70 for the microprocessor control unit assures that unit 60 provides a threshold current to the magnetic particle brake so that in no circumstance when the unit is powered will the stairs be in an unloaded condition. This assures that those utilizing the exercise device will not be subjected to a runaway machine.

Prior to microprocessor control unit 61 taking over control of the brake control unit 60, there is a full-brake function 72 which provides that absent any overriding controls from the microprocessor, a full braking force is applied. Microprocessor control unit 61 is not activated until ON/OFF switch 66 is placed in the ON position by an individual which, because of the location of the switch at eye level, cannot be depressed until such time as the individual is located on the exercise stair so that the switch is within his reach. This assures that the stairs will remain in the aforementioned locked or immobilized condition until such time as the individual is ready to exercise and switch on microprocessor control unit 61. The full brake power is applied also at the end of any program specified by the microprocessor control unit, and also if the ON/OFF switch is turned to its off position at any time. Thus in normal operation an individual could not mount the stairs with unlocked stairs. It is possible to include a sensor on shaft 36 which would sense the absence of an individual on the stair and provide unit 61 with a signal which would result in the application of a lock-up signal to brake 50. It will be appreciated that a variety of sensors may be attached to shaft 36 or adjacent thereto to detect chain tension, thereby to establish the absence of an individual and provide an appropriate signal over line 74 to unit 61.

As a further safety feature for the escalator-type exercise machine, tachometer 52 provides an output signal which can, inter alia, indicate a runaway condition in which the stairs are moving at a speed faster than the predetermined threshold. This signal coupled over line 76 to unit 61 can be detected as being in excess of a predetermined threshold, again resulting in the application of a locking signal to brake 50.

Tachometer 52 is also utilized to provide an indication to display 64 as to the speed of the steps and therefore also to provide a measure of the number of steps climbed, as well as any other parameter related exercise. This feedback is applied over line 78 to microprocessor control unit 61 which can provide feedback control to unit 60 so that a constant braking force and therefore constant exercise speed is assured.

What is illustrated in FIG. 1 is an exercise machine which is under the control of an electromagnetic braking unit in which the electromagnetic braking unit is lockable, thereby to preclude operation of the exercise equipment until such time as the brake is unlocked. This is under the control of a switch which is located in such a fashion that it can only be manually operated by an individual on the exercise device. While the exercise device depicted is shown to be an escalator-type device, any type of exercise device which locates the individual using device at some distance above a floor should be provided with such a safety locking capability. This would include such exercise machines as exercise bicycles, elevated stair climbing apparatus, ski touring apparatus, or indeed any apparatus in which some type of exercise motion is converted to rotary motion. Thus the Subject Invention may be applied to any reciprocating exercise equipment such as reciprocating pedal or stand up body-lift machines.

Figure 2:
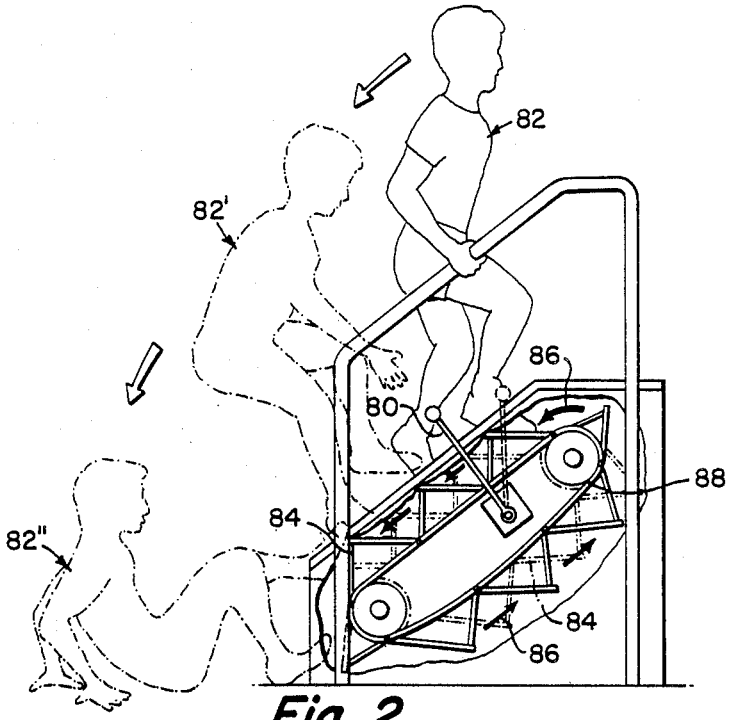
Fig. 2 (PRIOR ART)
FIG. 2 is a diagrammatic illustration of a prior art escalator type mechanically-braked system, illustrating the ability of the individual to fall off the machine when not properly braked.

While there can be many types of systems for permitting the movement of stairs 12, when such mechanisms are controlled by purely mechanical means as illustrated in FIG. 2 by lever 80, it will be seen that an individual 82 can step upon an unbraked machine, whereupon he can be thrown to the floor as illustrated in dotted outlines by 82' and 82'', with the motion of stairs 84 being in the direction of arrows 86. This unbraked condition causes the chain drive linkage 88 to release the stairs so that the individual is thrown to the floor. This is a common occurrence with escalator-type exercise equipment when using the pure mechanical braking system of U.S. Pat. No. 4,687,195.

Figure 3:
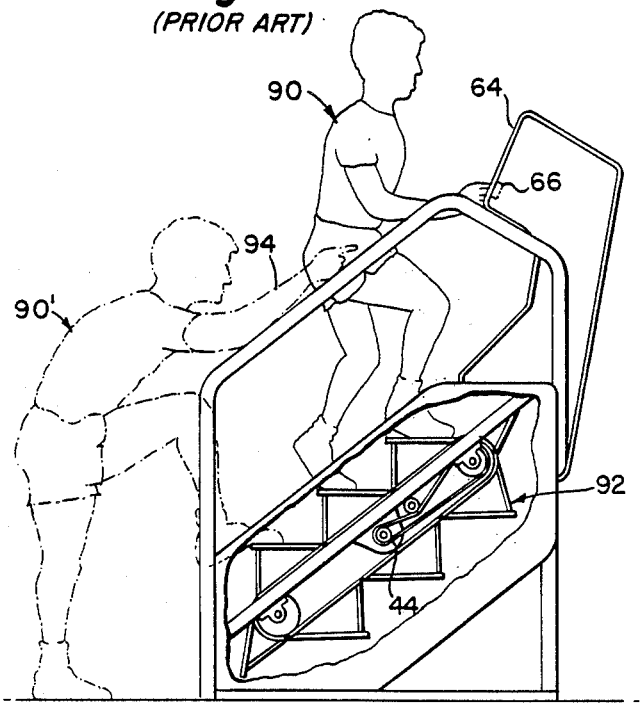
FIG. 3 is a diagrammatic illustration of the Subject System for utilization with a escalator type exercise apparatus in which the individual can only actuate the apparatus when he is in position, on the exercise stair; and, FIG. 4 is a side and diagrammatic illustration of the utilization of a magnetic fully-locking brake for the providing of torque to exercise apparatus.

In contradistinction to the problems associated with pure mechanical braking, a braking system such as illustrated at 44 in FIG. 3 is in a locked position until switch 66 is actuated by an individual 90 in place on the exercise machine 92. It will be appreciated that switch 66 is within easy reach of an individual when properly located on the exercise machine. However, as illustrated at 90' even the largest of individuals intending to utilize the machine cannot in any way reach switch 66 by extending his arm 94 if he is standing in front of the machine as illustrated.

What will be appreciated is that the machine is immobilized until such time as an individual is on the stairs in a position to exercise; at which point switch 66 is within his reach. This provides for a significant amount of safety, especially for exercise machines which cause the individual to be elevated above floor level by a significant amount.

Figure 4:
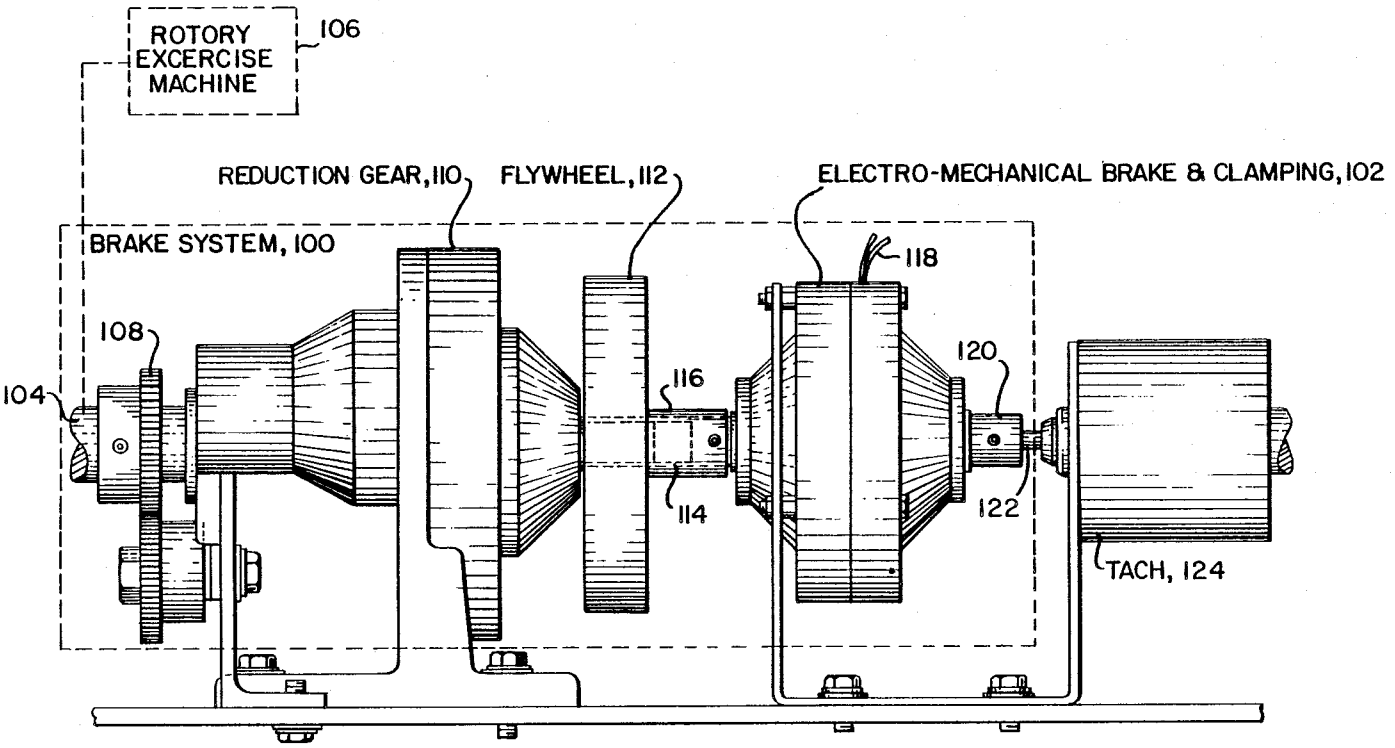

Referring now to FIG. 4, in general the Subject electromechanical safety-lock braking system, here illustrated at 100 may be used with any exercise machine in which exercise results in powering of a rotary member. System 100, on one embodiment includes an electromechanical brake and clamping unit 102 having an output shaft 104 which is coupled to any rotary exercise machine 106 via gears 108, reduction gears 110 and fly wheel 112. By rotary exercise machine is meant any machine in which, in the course of exercise, moveable exercise apparatus causes a shaft to rotate whether or not the exercise in itself directly generates the rotary shaft movement or indirectly generates it by virtue of movement of a portion of the exercise machine. The shaft on which the fly wheel 112 is mounted is illustrated at 114 to be coupled via sleeve 116 to the electromechanical brake and clamping unit 102 which is actuated via power applied to lines 118. The output shaft through the braking unit 102 is also coupled at its other end 120 to a shaft 122 of a conventional tachometer 124. It is the property of the electromechanical brake and clamping unit 102 that completely immobilizes the rotary exercise machine by locking its output shaft when either full power is applied to the device or when power to the braking device is interrupted. For the aforementioned magnetical particle brake and indeed for hysteresis-type brakes full locking of its output shaft is achieved through application of full rated power to the electromechanical brake. In other types of electromechanical brakes internal apparatus (not shown) clamps the output shaft of the brake in the absence of the application of power to the brake.

What will be appreciated is that not only is it unique to utilize a magnetic particle brake for exercise equipment due to its unique clamping capability, it is also possible to use any electromechanical brake which offers such output shaft clamping.

Moreover, it is unique to utilize anything other than a pure mechanical braking system for escalator stairs. The pure mechanical braking system has in the past resulted in frequent injury to the users of such machines and the interposition of any electromechanical brake such as either the magnetic particle brakes, the hysteresis brakes, the eddy current brakes or indeed the alternator braking systems are useful in preventing a runaway condition for the escalator stairs.

Having above indicated a preferred embodiment of the present invention, it will occur to those skilled in the art that modifications and alternatives can be practiced within the spirit of the invention. It is accordingly intended to define the scope of the invention only as indicated in the following claims:

I claim:

1. In combination with escalator type exercise apparatus including an inclined and hinged set of stairs, means for guiding movement of said stair down an incline, and means coupled to said stairs for limiting the movement thereof in a downward direction when an individual is standing on one of said stairs, said limiting means including electromagnetic braking means for controlling the movement of said stairs down said incline, said electromagnetic braking means including a shaft connected to said stairs, means for substantially locking said shaft and means actuatable by said individual for deactivating said locking means.

2. The apparatus of claim 1 wherein said electromagnetic braking means further includes means for applying electric power to said electromagnetic braking means in accordance with a predetermined exercise program.

3. The apparatus of claim 2 wherein said electromagnetic braking means includes magnetic particle brake means.

4. The apparatus of claim 2 wherein said electromagnetic braking means includes a hysteresis brake means.

5. The apparatus of claim 2 wherein said electromagnetic braking means includes alternator brake means.

6. The apparatus of claim 2 wherein said electromagnetic braking means includes eddy current brake means.

7. The apparatus of claim 2 wherein said electromagnetic braking means includes a speed-controlled motor.

8. The apparatus of claim 1 wherein said electromagnetic locking means is activated upon removal of power to said apparatus.

9. The apparatus of claim 2 and further including means associated with said means for applying electric power for smoothing changes in power to said electromagnetic braking means, thereby to cushion exercise changes for the individual using said exercise apparatus.

10. The apparatus of claim 2 and further including means for applying a predetermined amount of power to said electromagnetic braking means sufficient to provide a threshold braking torque to said stairs so as to limit the downward movement of said stairs for preventing a runaway condition.

11. The apparatus of claim 2 wherein said electromagnetic braking means further includes an output shaft, means for varying the electric power applied to said electromagnetic braking means to regulate the speed of movement of said stairs, a tachometer coupled to said shaft, and means for coupling the output of said tachometer as a feedback signal to said electric power varying means so as to establish a uniform speed of stair movement.

12. The apparatus of claim 2 wherein said electromagnetic braking means further includes means for ascertaining the speed of descent of said stairs, and wherein said means for immobilizing said stairs from movement is activated when the speed of said stairs exceeds a predetermined threshold.

13. The apparatus of claim 2 wherein said deactivating means further includes switch means located at said exercise apparatus at a position reachable only when said individual is standing on said stairs for defeating the immobilization of said stairs, whereby said deactivating means releases said immobilized stairs only when said individual is already positioned on said stairs.

* * * * *